US011719244B2

(12) United States Patent
Stones et al.

(10) Patent No.: US 11,719,244 B2
(45) Date of Patent: Aug. 8, 2023

(54) PUMP HAVING LIQUID BLADES AND AN ASSOCIATED METHOD OF PUMPING

(71) Applicant: Edwards Limited, Burgess Hill (GB)

(72) Inventors: Ian David Stones, Felbridge (GB); Nigel Paul Schofield, Horsham (GB); Ian Andrew Norton, Bristol (GB)

(73) Assignee: Edwards Limited, Burgess Hill (GB)

( * ) Notice: Subject to any disclaimer, the term of this patent is extended or adjusted under 35 U.S.C. 154(b) by 245 days.

(21) Appl. No.: 16/639,528

(22) PCT Filed: Aug. 16, 2018

(86) PCT No.: PCT/GB2018/052322

§ 371 (c)(1),
(2) Date: Feb. 14, 2020

(87) PCT Pub. No.: WO2019/034877

PCT Pub. Date: Feb. 21, 2019

(65) Prior Publication Data

US 2021/0172440 A1 Jun. 10, 2021

(30) Foreign Application Priority Data

Aug. 17, 2017 (GB) ..... 1713187

(51) Int. Cl.
*F04D 17/18* (2006.01)
*F04C 25/02* (2006.01)
(Continued)

(52) U.S. Cl.
CPC ..... *F04D 17/18* (2013.01); *F04C 25/02* (2013.01); *F04C 29/0057* (2013.01);
(Continued)

(58) Field of Classification Search
CPC ..... F04D 17/18; F04C 25/02; F04C 29/0057; F04C 29/0092; F04C 29/124;
(Continued)

(56) References Cited

U.S. PATENT DOCUMENTS 2,057,381 A * 10/1936 Kenney ..... F01C 21/0809 418/150
2001/0026759 A1 10/2001 Kraner
(Continued)

FOREIGN PATENT DOCUMENTS

CH 299020 5/1954
CN 104235020 A 12/2014
(Continued)

OTHER PUBLICATIONS

English Translation of CH299020A, (translation supplied by Espacenet on Sep. 7, 2021) (Year: 1954).*
(Continued)

*Primary Examiner* — Dominick L Plakkoottam
*Assistant Examiner* — Paul W Thiede
(74) *Attorney, Agent, or Firm* — Shumaker & Sieffert, P.A.

(57) ABSTRACT

A pump and method for pumping a gas are disclosed. The pump comprises a rotor and a stator. At least one of the rotor or stator comprises at least one liquid opening configured for fluid communication with a liquid source. The liquid opening is configured such that in response to a driving force exerted on liquid from the liquid source a stream of liquid is output from the opening, the stream of liquid forming a liquid blade between the rotor and the stator, gas confined by said stator, said rotor and said liquid blade being driven through said pump from a gas inlet towards a gas outlet.

23 Claims, 8 Drawing Sheets

(51) Int. Cl.
*F04C 29/00* (2006.01)
*F04C 29/12* (2006.01)

(52) U.S. Cl.
CPC ..... *F04C 29/0092* (2013.01); *F04C 29/124* (2013.01); *F04C 2210/22* (2013.01); *F04C 2220/10* (2013.01); *F04C 2240/10* (2013.01); *F04C 2240/20* (2013.01); *F04C 2240/40* (2013.01); *F04C 2240/50* (2013.01); *F04C 2240/603* (2013.01); *F05B 2210/12* (2013.01)

(58) Field of Classification Search
CPC ..... F04C 2210/22; F04C 2220/10; F04C 2240/10; F04C 2240/20; F04C 2240/40; F04C 2240/50; F04C 2240/603; F05B 2210/12
See application file for complete search history.

(56) References Cited

U.S. PATENT DOCUMENTS

| | | | | |
|---|---|---|---|---|
| 2005/0271520 | A1 | 12/2005 | Karoliussen | |
| 2010/0061908 | A1* | 3/2010 | Smith | F04F 5/54 423/240 R |
| 2014/0363319 | A1 | 12/2014 | Carboneri et al. | |

FOREIGN PATENT DOCUMENTS

| | | | |
|---|---|---|---|
| DE | 1812234 | A1 | 8/1969 |
| FR | 1030088 | | 6/1953 |
| GB | 1282803 | | 7/1972 |
| GB | 1350853 | | 4/1974 |
| JP | S3512654 | | 9/1960 |
| JP | S55134791 | A | 10/1980 |
| JP | H09088873 | A | 3/1997 |
| JP | 2002527682 | A | 8/2002 |
| JP | 2005534843 | A | 11/2005 |

OTHER PUBLICATIONS

Combined Search and Examination Report under Sections 17 and 18(3) dated Jan. 31, 2018 in counterpart GB application No. GB1713187.1, 6 pp.
International Search Report and Written Opinion dated Oct. 30, 2018 in counterpart International Application No. PCT/GB2018/052322, 14 pp.
First Office Action dated Jul. 5, 2021 for counterpart CN Application No. 201880067980.3, 8 pp.
Translation of the Notification of Reasons for Rejection from counterpart Japanese Application No. 2020-509023 dated Jun. 16, 2022, 6 pp.

* cited by examiner

PUMP HAVING LIQUID BLADES AND AN ASSOCIATED METHOD OF PUMPING

This application is a national stage entry under 35 U.S.C. § 371 of International Application No. PCT/GB2018/052322, filed Aug. 16, 2018, which claims the benefit of GB Application 1713187.1, filed Aug. 17, 2017. The entire contents of International Application No. PCT/GB2018/052322 and GB Application 1713187.1 are incorporated herein by reference.

TECHNICAL FIELD

The field of the disclosure relates to pumps and methods of pumping.

BACKGROUND

Different types of pumps for pumping gases are known. These include entrapment type pumps, where a gas is captured on a surface inside the pump prior to being removed; kinetic or momentum transfer pumps such as turbomolecular pumps where the molecules of the gas are accelerated from the inlet side towards the outlet or exhaust side, and positive displacement pumps, where gas is trapped and moved from the inlet towards the outlet of the pump.

Positive displacement pumps provide moving pumping chambers generally formed between one or more rotors and a stator, the movement of the rotors causing the effective pumping chamber to move. Gas received at an inlet enters and is trapped in the pumping chamber and moved to an outlet. In some cases the volume of the gas pocket reduces during movement to improve efficiency. Such pumps include roots and rotary vane type pumps. In order to draw the gas into the chamber, the chamber generally expands and to expel the gas from the chamber, the chamber volume generally contracts. This change in volume can be achieved for example in a rotary vane pump by blades that extend in and out of the pump chamber using devices such as springs, which are themselves subject to wear, or using two synchronised rotors in a roots or screw pump which cooperate with each other and a stator to move a pocket of gas and generate the volumetric changes between inlet and outlet. An additional rotor requires an additional shaft, bearings and timing methods such as gears to synchronise the rotor movements.

Furthermore, in order to minimise or at least reduce leakage and move the gas efficiently while it is trapped the moving parts need to form a close seal with each other and with the static parts which form the trapped volume of gas. Some pumps use a liquid such as oil to seal between the surfaces of the trapped volume whilst others rely on tight non-contacting clearances which can lead to increased manufacturing costs and can also lead to pumps that are sensitive to locking or seizure if the parts come into contact or where particulates or impurities are present in the fluid being pumped.

Liquid ring pumps address some of these issues by providing a rotor with fixed blades that rotate eccentrically in a stator bore. The blades drive a volume of liquid towards the outer circumference of the stator bore by centrifugal action, gas pumping chambers being formed between adjacent blades of the rotor and the inner circumference of the ring of liquid. This provides a pump with low wear and good particulate tolerance as the rotor blades do not contact the stator bore and particulates can be accommodated in the large clearances and the liquid ring itself. However, a drawback is that this type of pump typically has a high power consumption and operates at low frequency to reduce drag losses, turbulence and cavitation. This can lead to a relatively large pumping mechanism for a given amount of pumping capacity.

It would be desirable to provide a pump that is resistant to wear, offers low power consumption and a relatively small pumping mechanism and is relatively inexpensive to manufacture and operate.

SUMMARY

A first aspect of the present disclosure provides a pump for pumping a gas, said pump comprising: a rotor and a stator; at least one of said rotor or stator comprising at least one liquid opening configured for fluid communication with a liquid source; said liquid opening being configured such that in response to a driving force exerted on liquid from said liquid source a stream of liquid is output from said opening, said stream of liquid forming a liquid blade between said rotor and said stator, gas confined by said stator, rotor and liquid blade being driven through said pump from a gas inlet towards a gas outlet.

The inventors of the present disclosure recognised that were a liquid to be used to form a surface or blade between the rotor and stator then gas would be confined by the stator, rotor and liquid blade, allowing gas to be driven through the pump on rotation of the rotor. This would have the potential to provide a simple, compact, low power, low cost arrangement and the problems that arise due to friction and wear between contacting surfaces and the cost involved in manufacturing tolerances for tight clearances would be avoided or at least mitigated. They also recognised that such a blade could be formed in a simple manner by driving a liquid through one or more liquid openings. Arranging the liquid opening(s) on one of the stator or rotor allows a stream of liquid to form a liquid surface or blade between the rotor and stator. Such a liquid blade is by its nature, deformable, low cost, and able to provide good sealing between surfaces of the trapped volume without the need for tight manufacturing tolerances. Furthermore, such a blade is not subject to wear itself and provides very little wear on the surface that it contacts.

The blade is formed of a flowing liquid such that the liquid forming the blade is continuously replenished. A surface of the blade acts along with a surface of the rotor and stator to confine, trap, isolate or enclose the gas to be pumped. Rotation of the rotor causes the trapped gas to be moved from a gas inlet to a gas outlet.

The flow of liquid from a liquid opening provides a blade extending as a liquid surface from the liquid opening between the rotor and stator. Gas to be pumped is located on either side of the blade.

For the purposes of this patent application the rotor of the pump is the rotating element and the stator is the element that the rotor rotates with respect to. Furthermore, the gas to be pumped may be a vapour, or a gas vapour mixture, or a gas having particles entrained within it.

In some embodiments, the rotor is rotatably mounted within a bore of the stator and the stream of liquid forming the liquid blade between the rotor and the stator bore is operable to drive the gas through the pump on rotation of the rotor within the stator bore.

Rotation of the rotor provides relative motion between the surfaces enclosing the gas pocket, such that in some embodiments the liquid blade drives the gas along a pumping path from a gas inlet to a gas outlet. This relative motion along with, in some embodiments, a change in volume of the gas pocket can be provided without any appreciable wear on the surfaces confining the gas pocket as at least one is formed from a liquid blade and due to its deformable nature its surface shape and size will adapt to the distance between the rotor and stator during rotation.

In some embodiments said pump comprises a driving mechanism for exerting said driving force on said liquid to drive said liquid from said liquid source through said at least one liquid opening.

Although the driving force exerted on the liquid may come from a source external to the pump, the pump may for example be connected to an external pressurised liquid source, in some embodiments the pump itself comprises a driving mechanism for exerting this driving force on the liquid.

Although the liquid openings may be formed on the surface of the rotor, in some embodiments they are formed on the surface of the stator bore and directed towards the rotor. This may have the advantage of allowing a simpler way of supplying pressurised liquid to the pump as unlike the rotor, the stator bore does not rotate and in some embodiments provides an outer surface of the pump.

In some embodiments, said rotor is a hollow body and said driving mechanism comprises a motor for rotating said rotor.

One way of providing the driving force to the liquid where the liquid opening(s) are on the rotor is to use a hollow rotor and to spin this rotor. In such an embodiment, the spinning of the rotor may cause liquid within the hollow rotor body to be forced by centrifugal action against the outer circumference of the hollow rotor body and out through the one or more liquid openings forming a liquid stream. Where the liquid openings are arranged appropriately this liquid stream will form the liquid blade extending to the stator bore.

In some embodiments, said liquid source comprises a reservoir in which said rotor is partially immersed.

One way of supplying liquid to the hollow rotor is to partially immerse the rotor in a reservoir of the liquid.

In some embodiments, said hollow rotor has an opening at a lower end extending into said liquid reservoir, an internal diameter of said hollow rotor increasing from said lower end. Spinning the rotor will cause the liquid to rise up within the rotor and be expelled through the liquid opening(s).

It is desirable if the internal diameter of the hollow rotor body increases from a bottom towards an upper end, the bottom end being immersed in the reservoir. In this way at the lower end that is immersed in the liquid reservoir there is a smaller diameter and the diameter increases up the hollow body. This causes liquid pushed by a centrifugal force against the inner surface of the hollow body to rise up the increasing internal diameter towards the top of the rotor body. The increase in diameter may be a sloped increase or it may be a stepped increase or it may be a combination of the two. It may also be complemented by vanes on the internal surface of the rotor to support the acceleration of the liquid towards the larger diameter. The liquid is thrown out towards the inner surface of the hollow body and rises up pushed up by the acceleration and pressure of the following liquid. The speed of rotation will affect how high the liquid is pushed up the hollow body, as will other parameters such as the density of the liquid. Appropriate speeds and sizes of rotor can be selected according to the desired flow rate of the liquid to be pumped through the openings to form the blades or vanes. It should be noted that sufficient liquid should be supplied from the reservoir into the hollow rotor body to maintain an uninterrupted stream of liquid between the rotor and the stator in order for the gas to be effectively pumped. This again will depend on the parameters such as the rotating speed of the rotor and also the size and number of openings, and the height of the rotor.

In some embodiments said rotor and stator are mounted one within a bore of the other, such that one comprises an inner component and the other comprises an outer component.

The pump may be formed of a rotor and stator mounted with parallel axes one inside the other. The rotor rotates providing relative motion between the two components, this relative motion provides the driving force for pumping the gas. In some embodiments, the rotating component (the rotor) is the inner component while in others it is the outer component.

In some embodiments said inner component is eccentrically mounted within said bore of said outer component, while in others said inner component is concentrically mounted within said bore of said outer component.

Eccentrically mounting the inner component means that when there is relative rotation the gas pocket formed by the stator, rotor and liquid blade will change in volume. This change in volume allows gas at an inlet to be sucked into the pumping chamber as the chamber confining the gas pocket expands and to be forced out of the gas outlet as it contracts. In this way, the pump acts in a similar way to a rotatory vane pump with the deformable liquid surface forming the blades. As can be seen these blades will in effect change in size as the rotor rotates but this will happen naturally as part of the rotor surface moves towards and away from the stator. There is no requirement for mechanical or sliding parts such as springs and solid blades to create the changing volume of the pumping chambers.

In some embodiments said pump further comprises a sealing member for sealing between said stator and said rotor, a gas inlet being on one side of said sealing member and a gas outlet on the other side.

Where the rotor and stator are mounted concentrically and the liquid opening(s) are on the rotor, then a sealing member between the stator and rotor can form a wall of two pumping chambers that are located on either side of the sealing member. These pumping chambers will change in volume as the rotor rotates. A gas outlet can be on the side of the sealing member towards which the rotor rotates, and the gas inlet can be on the far side.

In some embodiments, said at least one liquid opening extends along at least a portion of a length of one of said stator or rotor, said at least one liquid opening being configured to provide said liquid blade as a surface extending at least partially in an axial direction between said stator and rotor.

Although the liquid openings may be arranged in a number of different ways, they may be arranged in a way such that liquid expelled from them forms a liquid blade that extends along at least a portion of the length of the pump between the rotor and stator.

In some embodiments, said pump further comprises a protrusion extending from a surface of one of said rotor or stator not comprising said at least one liquid opening.

One of the stator or rotor may have at least one liquid opening with the other one having a protrusion, such that relative rotation between the two causes the liquid blade(s) formed from the at least one liquid opening to sweep gas along the path formed by the protrusion.

The liquid opening(s) may be arranged in a number of ways. There may be a plurality of liquid openings arranged adjacent to each other, or there may be a single opening in a slot form. In some embodiments, the slot or plurality of openings has a longitudinal form running substantially parallel to an axis of the rotor and stator. Such an arrangement provides a blade substantially perpendicular to the radius of the pumping chamber.

In other embodiments the slot or adjacent openings may be angled with respect to the axis of the stator and rotor and in some cases may form a helix such that a helical liquid blade is formed between the stator and rotor.

A helical slot or a helix formed of a plurality of openings extending around the surface of one of the stator or rotor provides a pump that acts in a similar way to a screw pump.

A pump configured to generate such a blade may be used in conjunction with a helical protrusion on the surface of the other component, or in conjunction with a plane surface.

In some embodiments, an angle of said helix changes from said gas inlet towards said gas outlet such that a pitch of said helix reduces towards said gas outlet.

Providing volumetric compression to the gas as it is pumped not only aids in the expelling of gas from the chamber but also reduces the power required for pumping a given volume of gas.

In a rotary vane type of arrangement the volumetric compression is provided due to the eccentric mounting of the rotor within the stator bore as the rotor rotates and the blades move around the stator bore.

In the case of a screw type arrangement a way of providing a pumping chamber which reduces in size between the gas inlet and gas outlet is to vary the pitch of the helix from the inlet towards the gas outlet. This generates volumetric compression along the length of the pump axis.

In some embodiments, at least one of said stator and said rotor are tapered such that a distance between said stator and said rotor reduces towards said gas outlet.

A further way of providing a pumping chamber which reduces in size between the inlet and outlet is to provide a tapering such that the distance between the stator and rotor reduces towards the gas outlet. In some embodiments it is the stator that is tapered. Tapering of the stator that does not rotate is often the simplest way of generating the reduction in size of the pumping chamber towards the gas outlet.

In some embodiments at least one of said stator and said rotor are non axisymmetrically tapered such that a distance between said stator and said rotor reduces towards said gas outlet.

In some embodiments it is the bore of the outer component that is non axisymmetrically tapered towards said gas outlet, while in other embodiment the inner component may have an increasing diameter.

A non-axisymmetric taper may help in the exhaustion of gas through the gas outlet and the aspiration of gas through the gas inlet.

Where it is the stator that is tapered, the rotor may be maintained parallel and close to the stator on one side, to seal along this length and the stator bore is tapered on the side that is more remote from the rotor. The gas outlet may be arranged just before, in a rotational direction of the blades, the part where the rotor and stator form a seal while the gas inlet may be just after it.

In some embodiments, said at least one liquid opening is arranged at an angle that is not perpendicular to a surface of said rotor and said liquid is supplied to the rotor as pressurised liquid, output of said pressurised liquid at said angled liquid opening providing a driving force for rotating said rotor.

Where liquid openings are arranged at an angle to the surface of the rotor, output of the liquid can itself impart a force to the rotor to cause the rotation of the rotor. This obviates the need for a motor to drive the rotor and can reduce the cost of the pump and make it both simple and cost effective to build.

In some embodiments, said driving mechanism comprises a pressurising means for pressurising said liquid supplied from said source.

As noted previously, in some embodiments the driving mechanism for driving the liquid from the liquid source to the openings may be imparted by rotation of the rotor, while in other embodiments the driving mechanism may comprise a pressurising means for pressurising the liquid suppled from the source. In some embodiments, the liquid may supplied in a pressurised form independently from rotation of the rotor. This allows a slower rotation of the rotor and pumping chambers than where the rotor is required to generate the necessary pressure in the liquid.

In some embodiments, said gas inlet and said gas outlet are formed on said stator and each comprise one-way valves.

In other embodiments, said pump comprises a plurality of gas inlets and gas outlets formed on said stator and each comprising one-way valves.

In some embodiments, said pump comprises a motor for driving a shaft said rotor comprising a substantially circular eccentric cam mounted on said shaft, said shaft being mounted concentrically to a stator bore.

A further type of pump which may operate well with liquid openings being on the stator bore is one where the rotor is a circular eccentric cam which rotates within the stator bore. Rotation of the rotor causes a pumping chamber between the rotor outer surface and stator inner bore surface and the liquid surface to vary in size causing gas to be sucked in via a gas inlet valve as the pumping chamber expands and pushed out through a gas outlet valve as the pumping chamber contracts, similar to the operation of a piston pump.

In some embodiments, said plurality of liquid openings provide a plurality of streams of liquid which form a plurality of liquid blades between said rotor and said stator.

Although, the pump may comprise a single liquid opening to form a single liquid blade in some embodiments it comprises a plurality of liquid openings. Liquid from the plurality of openings may form a single blade or the openings may be arranged such that liquid expelled from them forms a plurality of blades.

In some embodiments, at least one set of said plurality of liquid openings are arranged adjacent to each other and streams output from said at least one set of said plurality of liquid openings combine to form a single liquid blade.

In some cases there may be a plurality of openings and a set of these may form a single blade. Where there is only one blade this set may comprise all the liquid openings, while in other embodiments, there may be several sets each set arranged to form their own blade. Although a liquid blade may be formed from a single liquid opening in the form of say a slot, in some embodiments it may be formed by a plurality of adjacent openings that are close enough together for the streams of liquid through each to coalesce and form a single blade. Having a plurality of openings rather than a single slot may improve the structural integrity of the rotor or stator that they are arranged on and thereby improve the mechanical integrity of the pump.

In some embodiments, said pump comprises a plurality of pairs of gas inlets and gas outlets, each pair of gas inlets and gas outlets being separated by a liquid opening providing said liquid blade between said pairs of gas inlets and gas outlets.

Where for example the pump comprises a circular eccentric cam rotor then there may be a plurality of pairs of gas inlets and gas outlets with each pair and each gas volume being separated by a liquid opening. Rotation of the eccentric cam causes the pumping chamber bounded by the liquid surface formed from the liquid opening to initially increase in volume sucking gas in through the inlet and then contract pushing it out through the outlet. The inlets and outlets may each be valved. These plurality of pairs of gas inlets and outlets can be connected in series or in parallel to change the performance characteristics of the pump.

In some embodiments, said pump comprises a gas inlet and a gas outlet and at least one pumping chamber for moving said gas between said gas inlet and said gas outlet, the pump being configured such that in operation said liquid surface, a surface of said rotor and a surface of said stator bore form surfaces of at least one pumping chamber.

In some embodiments, said pump comprises at least one hydrodynamic bearing to support at least one end of said rotor.

Rotors of pumps are supported on bearings and typically these are roller bearings or ball bearings which can be expensive parts, requiring lubrication and subject to wear. A hydrodynamic bearing which utilises a liquid film between a cylindrical shaft and bore may be appropriate for this type of pump. In some cases the hydrodynamic bearing is filled with liquid from the same liquid source as the pump blades making efficient use of the liquid supply and mechanical features already used in the rotor and stator and avoiding the use of additional components or a different lubricant liquid.

Although the pump may be a number of things such as a compressor, in some embodiments it comprises a vacuum pump. Pumps according to embodiments, make particularly effective vacuum pumps allowing gas to be transported in an efficient manner with low wear and a low initial cost.

A second aspect of the present disclosure provides a wet scrubber for reducing pollutants pumped from an abatement system, said wet scrubber comprising a pump according to first aspect of the present disclosure.

Abatement systems are often used in conjunction with wet scrubbers which provide a stream of liquid to react with gases or remove particulates from the gases that are pumped from the abatement system. A pump that uses a liquid surface to move the gas may be used either in conjunction with an additional liquid scrubbing source or on its own, providing both the liquid source and the pumping required to move the gas and to remove particulates from it.

A third aspect of the present disclosure provides a method of pumping a gas comprising: outputting liquid from at least one liquid opening on one of a stator or rotor to form a liquid blade between a surface of a rotor and a stator; rotating a rotor and thereby causing gas confined by said stator, said rotor and said liquid blade to travel along a pumping path from a gas inlet to a gas outlet.

In some embodiments said method comprises rotating said rotor within a bore of said stator to cause said liquid blade to drive said gas along said pumping path.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present disclosure will now be described further, with reference to the accompanying drawings.

DETAILED DESCRIPTION

Before discussing the embodiments in any more detail, first an overview will be provided.

Embodiments provide a pump comprising liquid blades that are high velocity surfaces formed of liquid, which surfaces emulate some of the solid mechanical surfaces which are found in conventional vacuum pumps and which are used as the physical boundaries to isolate and move pockets of gas. The liquid may be water, other liquids may be used for example to change characteristics of the pump such as vapour pressure or process compatibility.

The size and shape of the liquid surfaces will adapt to the relative position of the rotor and stator unlike a rigid solid surface found in conventional pumps and will also provide a good seal with other surfaces without either causing appreciable wear on these surfaces or relying on tight tolerances or being sensitive to particulates in any gas or fluid flow being pumped.

FIGS. 1 to 4A show an embodiment that approximates to a rotary vane pump in its vacuum generation, replacing solid mechanical sliding vanes or blades with liquid surfaces.

The liquid "blades" are formed from a continuous stream of liquid originating from holes or slots in a rotating shaft that forms the rotor of the pump. The streams of liquid travel at high velocity towards an eccentric stator bore. The pressure required to drive the liquid from the shaft to the stator bore under high velocity can be achieved through centrifugal action of the rotating shaft. The surface formed from the stream of liquid and providing the liquid blade rotates with the shaft thus emulating the behaviour of a rotary vane pump.

Figure 1:
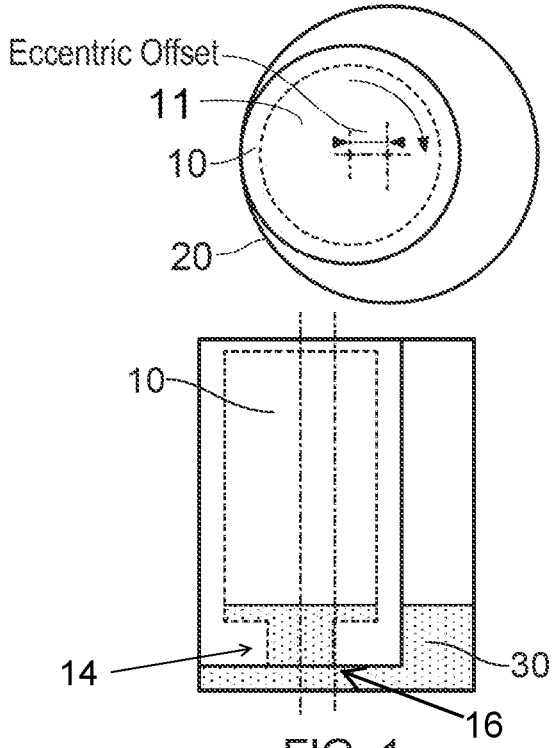
FIG. 1 shows cross section and longitudinal sections of a rotor eccentrically mounted in a stator bore.

FIG. 1 shows a cross section through a substantially circular hollow shaft which rotates at high frequency in a substantially circular stator bore 20. The shaft forms the rotor 10 of the pump and has an outside diameter that is smaller than the stator bore 20 inside diameter. The shaft is positioned eccentrically to approximately its maximum offset inside the stator.

The axes of the shaft and stator are orientated vertically and the base of the hollow open ended shaft is submerged in a liquid reservoir 30.

Figure 2:
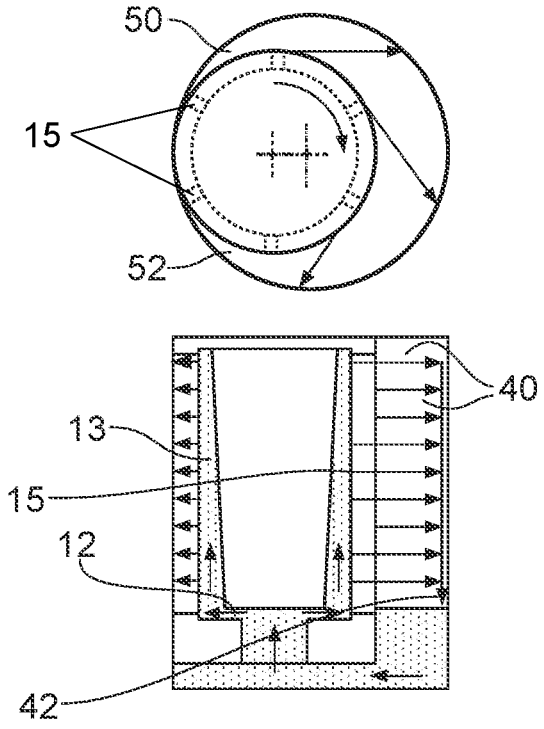
FIG. 2 shows the same rotor and stator bore with liquid openings provided on the surface of the rotor such that liquid flow from said openings form liquid surfaces or blades.

FIG. 2 shows the pump in operation with the liquid from liquid reservoir 30 rising up the shaft 10 on rotation of the rotor. The hollow bore of the shaft 10 has an internal increase in diameter positioned below the liquid reservoir level which serves when the shaft rotates to accelerate the liquid by centrifugal force and pump it up the inside of the shaft then out of holes or elongated slots (not shown) in the shaft to form a contiguous liquid surface 40 between the shaft or rotor 10 and the stator inner bore 20. The liquid 42 flows back down the inner wall of the stator bore 20 into the reservoir 30. This is on a continuous cycle basis, such that the liquid 42, in some embodiments water, that contacts the stator inner bore 20 travels down the bore under gravity and replenishes the reservoir. Note that the arrows depict the direction of flow of the liquid to create a single surface or blade 40.

The liquid inside the shaft is forced through the holes/slots under centrifugal force and travels towards the stator bore to form the plurality of liquid surfaces 40, these form blades that drive the gas through the pump as the rotor 10 rotates. This is shown in more detail in FIGS. 3A-3C.

Figure 3A:
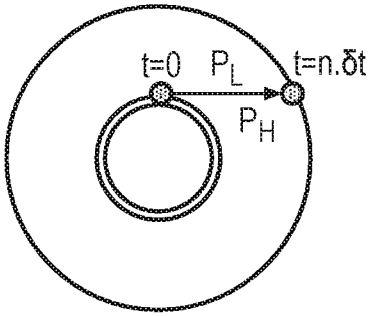
FIG. 3A-3C shows the trajectory of liquid output through a given liquid opening as the rotor rotates and the corresponding surface or blade created by a stream of liquid.
Figure 3B:
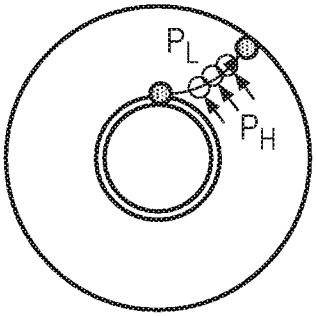
Figure 3C:
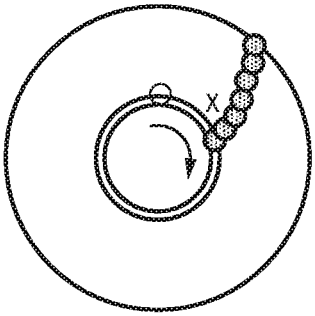

FIG. 3A shows the trajectory of a droplet of water if one ignores the pressure effects of the differential pressure due to the pumping action of these surfaces, FIG. 3B shows a more realistic droplet trajectory where the effects of the pressure differential are considered, while FIG. 3C shows an instantaneous image of the blade as a sum of several droplets each emitted from the opening at subsequent times.

FIGS. 3A-C shows that as the shaft of rotor 10 rotates, the continuous release of liquid through a given hole/slot provides a surface 40 equivalent to a curved blade, the effective surface of which rotates with the shaft. FIG. 3A shows the droplet motion due to centrifugal force. FIG. 3B shows the droplet motion where both centrifugal force and the pressure difference on either side of the liquid blade are considered. FIG. 3C shows the blade profile due to centrifugal force, pressure differences and rotation. The pressure difference across the liquid surfaces (PH-PL) is due to the pumping action of these surfaces. The slower the liquid is expelled the more the liquid is deflected by the pressure difference. The faster the liquid is travelling the less it is deflected by the pressure difference. Thus, the speed of rotation should be selected to be high enough for the velocity of the liquid to be sufficient to maintain an uninterrupted surface between the rotor and inner stator wall. This high rotational velocity also allows a physically small pump to have a relatively high pumping capacity. For example, a vacuum pump with a stator diameter of 150 mm and axial length of 100 mm running at 200 Hz could provide in excess of 500 m3/h displacement. This is just an example and could be scaled up or down. What should be noted is the performance density (capacity as a function of physical size). The pump principle may provide ~300,000 m3/h per m3 volume. This is enabled by both the high frequency of rotation and high space efficiency when compared to a liquid ring pump as there is no liquid ring consuming redundant space.

Figure 4A:
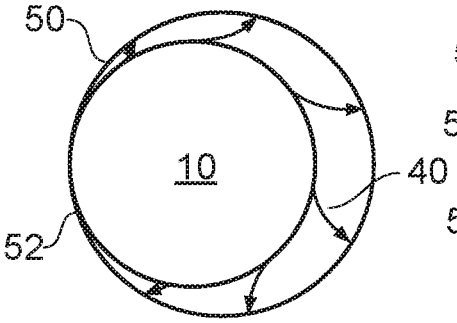
FIGS. 4A and 4B show gas pockets/volumes formed between adjacent liquid surfaces.

FIG. 4A shows how gas pockets or volumes trapped between adjacent liquid blades are moved by such a pump. The gas pockets move and change in volume as a function of shaft rotation and eccentric position to the bore resulting in the pumping action from inlet to outlet. The gas ports 50, 52 could be provided with one-way valves As FIGS. 3A-C and 4A show, the shape of the resulting liquid surfaces 40 which form the blades will be curved due to a combination of the shaft rotation and pressure drop. To explain this it is useful to consider the motion of an individual 'droplet' and the resulting 'surface' generated by a stream of 'droplets'.

For example, at time t=0, droplet 1 is released from the shaft at radius 'r'. At time $t=\delta t$ the same droplet 1 will now be at radius $r+\delta r$ and another droplet will be released from the same hole/slot at an advanced angle according to the shaft frequency. When the first droplet reaches the stator bore at time $t=n\cdot\delta t$ it will represent the 'tip' of the blade and at this same point in time the droplet being emitted from the same hole/slot in the shaft forms the 'root' of the blade.

The water blade observed at a specific point in time is therefore a product of the continuous stream of liquid 'droplets' over time $n\cdot\delta t$ (the time it takes a droplet to travel from the shaft to the stator bore). In this time the shaft has rotated giving the root, tip and intermediate positions different tangential trajectories and the curved appearance of the blade.

When pumping gas there will also exist a pressure drop across the blade which will serve to deflect the droplets from their nominally tangential trajectory and amplify the curvature of the blade. The amount of deflection/curvature depends on several parameters including the pressure drop, liquid velocity, liquid mass/density and distance of travel. An adverse combination of these values could 'stall' the droplet before it reaches the stator bore and prevent the blade fully forming. Therefore these parameter values should be selected in combination to provide the complete formation of the blade between shaft and stator.

These parameters also impact the volume of liquid circulating in the system and consequently the power consumed to generate the liquid kinetic energy.

Drivetrain, bearings, seals etc. are not shown in the diagrams.

Key Parameters to Consider to Provide Effective Pumping Operation

- Liquid circulation rate—The feed of liquid into the shaft and drainage back to the reservoir should be maintained to exceed the rate at which the liquid leaves the shaft through the holes/slots 15 otherwise the blade surface 40 will not fully form. Therefore the holes/slots should preferably be 'restrictive' compared to the flow into the shaft of rotor 10 and reservoir 30.
- Shaft frequency & internal/external diameter—affect liquid circulation rate and kinetic energy or power consumption, liquid velocity and maximum pressure drop, pumping speed.
- The gap between the Shaft outer diameter and stator bore inner diameter affects the maximum pressure drop and pumping speed.
- Axial length of blade/pump affects pumping speed, liquid circulation rate and kinetic energy or power consumption The above parameters should be considered and selected in combination to provide a pump with particular properties.

Figure 4B:
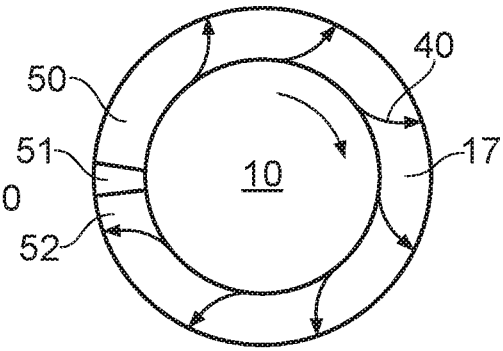

FIG. 4B shows a concentric alternative arrangement to the eccentric arrangement of FIG. 4A. In this arrangement, there is a seal 51 between the gas inlet and gas outlet and it is this that causes the change in pumping chamber volume on rotation of the rotor 10, causing the gas to be expelled through outlet 52 and sucked in through inlet 50. The concentric arrangement can provide a higher volumetric capacity as the length of the blades 40 do not change on rotation of the rotor. Thus, there is no portion with a longer blade and consequent higher sensitivity to pressure difference between pumping chambers. By contrast the advantages of the arrangement of FIG. 4A are a natural sealing point without the need for a separate seal and built-in smooth volumetric compression.

Figure 5A:
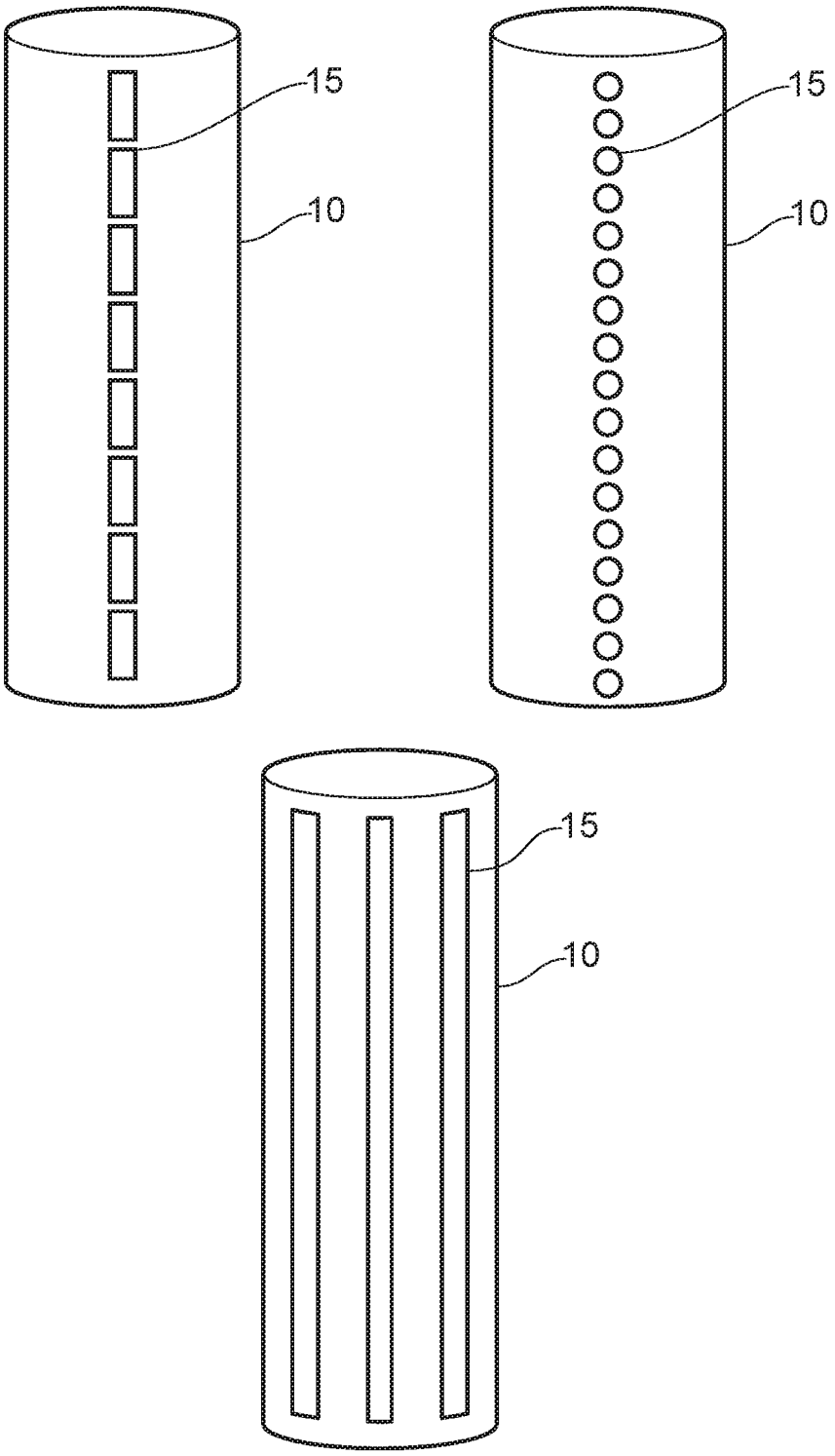
FIG. 5A shows different liquid opening arrangement on a rotor of a pump according to an embodiment where the rotor is mounted within the stator bore.

FIG. 5A shows different arrangements of liquid openings 15 on rotating shafts 10 of pumps arranged to form longitudinal blades. The liquid openings can be formed of a plurality of slot type holes 15 arranged in a line as shown in the first Figure, or of a plurality of round holes 15 as shown in the second figure or as a longitudinal liquid opening or slot 15 extending along substantially the whole length of the rotor 10. In many embodiments there will be a plurality of blades formed by liquid openings arranged at different circumferential positions around the rotor. Liquid output through each longitudinal arrangement of openings forms a liquid blade in a pump arrangement which is analogous to a rotary vane pump. Where the longitudinal blade is not formed from liquid output through a single slot but rather from liquid output through a plurality of adjacent openings along a line, then the liquid output from each adjacent opening coalesces to form the liquid blade.

Figure 5B:
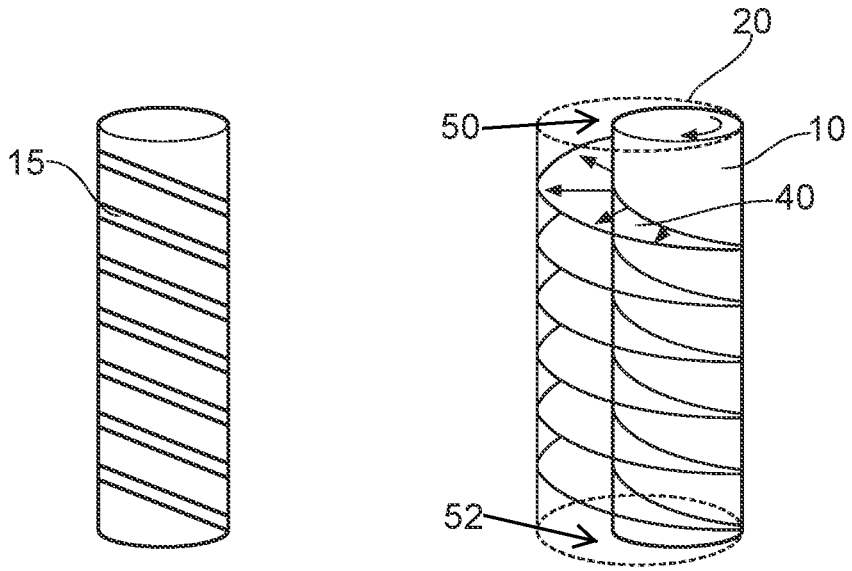
FIGS. 5B to 5F show different embodiments of pumps with the stator and rotor being mounted one within the other.

FIG. 5B shows an alternative eccentric helical screw embodiment, where axial pumping is provided by a single shaft screw pump that drives the gas from gas inlet 50 at the top to the gas outlet 52 towards the bottom, the walls of the screw being formed by a helical liquid surface 40. The rotor 10 shown in more detail in the left hand side of the figure has a helical liquid opening 15, liquid output from which forms the screw shaped liquid surface. The liquid opening 15 is shown as a single helical slot, but as for FIG. 5A can be formed from a plurality of openings arranged adjacent to each other along a helical path. As can be seen from the rotor depicted in the left hand side of the Figure the pitch of the helix reduces towards the gas outlet 52 to provide volumetric compression of the gas as it is pumped. One advantage of this embodiment is that it enables the liquid reservoir 30 (at the base of the rotor) to be located away from the gas inlet 50 (at the top of the rotor). This prevents a large pressure drop occurring across the liquid reservoir. Furthermore, the gas inlet 50 is closest to the customer equipment in the case of a vacuum pump so having the reservoir and any associated drainage remote from this can be advantageous. The pitch of the helix can be selected to decrease towards the gas outlet providing compression of the gas and increasing pumping efficiency.

Conventionally screw type pumps have been formed with two rotating shafts each with cooperating solid screw profiles but the deformability of the helical liquid surface and eccentric arrangement of the shaft in the stator bore allows it to be formed with a single shaft.

Figure 5C:
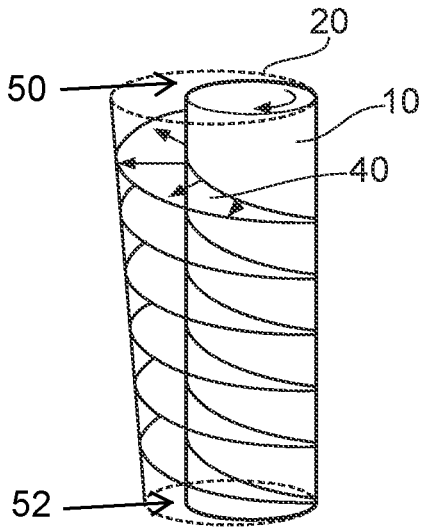

A further similar embodiment is shown in FIG. 5C. As in FIG. 5B rotation of the shaft of rotor 10 within stator bore 20 provides a rotating helical blade 40 by output of liquid through the rotating helical opening 15. This embodiment, however, utilises a variable root-tip diameter to shorten the radial gap towards the outlet by either reducing stator bore 20 diameter as illustrated or by increasing the diameter of the shaft of rotor 10 or by both. This provides an internal volumetric compression which can improve compression efficiency and reduce the maximum liquid velocity/flow rate required to sustain a blade at the higher pressure drop end of the pump thereby reducing power consumption. Where it is the stator that is tapered, the rotor may be maintained parallel and close to the stator on one side, to seal along this length and the stator bore is tapered on the side that is more remote from the rotor. The gas outlet may be arranged just before, in a rotational direction of the blades, the part where the rotor and stator form a seal while the gas inlet may be just after it.

Further volumetric compression can in some embodiments be provided by a variable pitch helical liquid blade such as is shown in FIG. 5B. The pitch of the blade reduces towards the outlet to again reduce the volume of the pumping chamber towards the high pressure end of the pump.

Figure 5D:
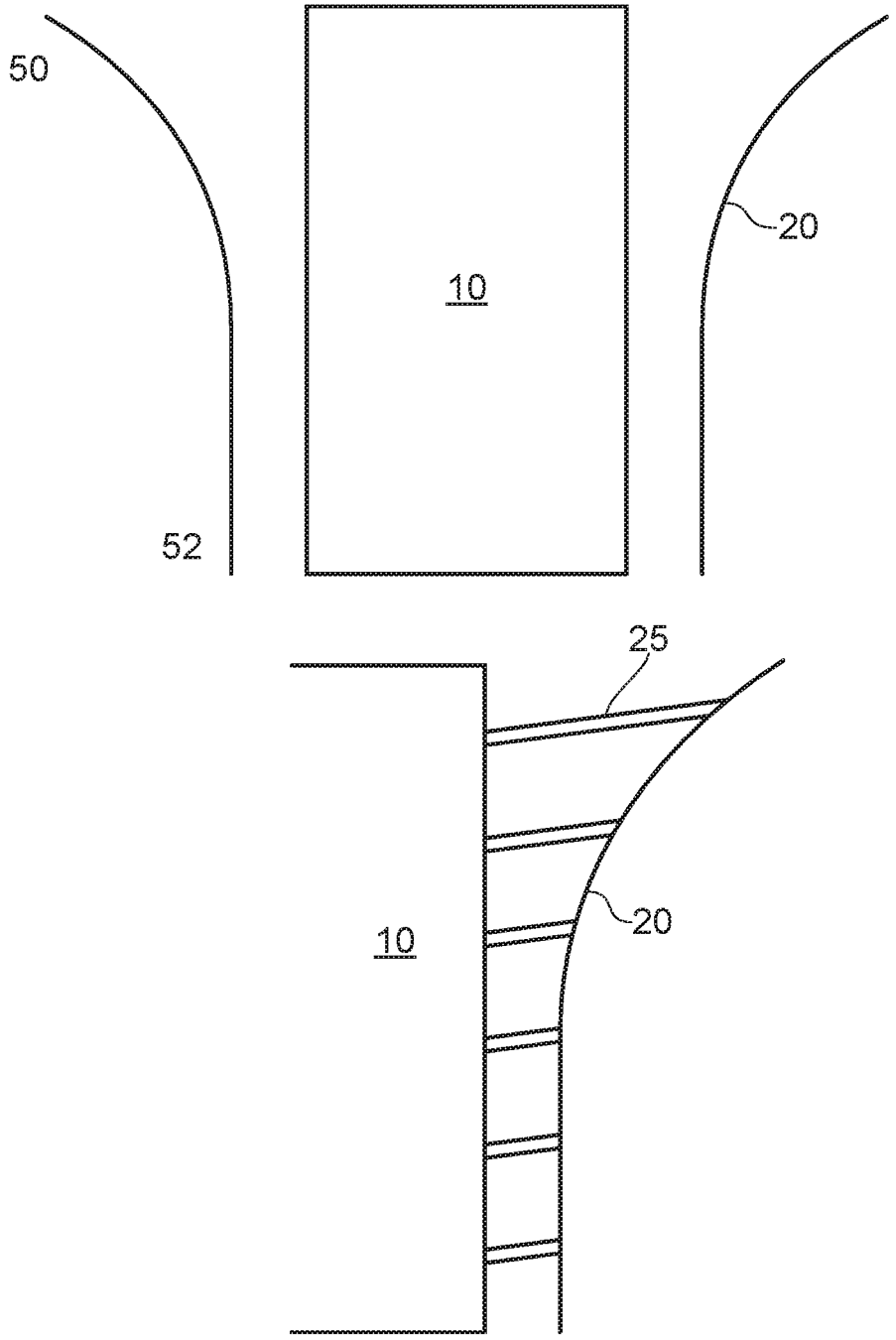

FIG. 5D shows a further embodiment with a tapered stator providing volumetric compression towards a gas outlet 52, in this embodiment there is a concentric rotor 10 within a tapered stator 20. A solid helical thread 25 extends from the stator to the rotor 10. In some embodiments (not shown) the liquid openings on the rotor may have a slot type longitudinal form as shown in FIG. 5A to provide axial blades that drive the gas along the helical path formed by the thread. Thus, as the rotor 10 rotates within stator 20 gas from an inlet 50 is driven along a helical path towards outlet 52. The tapered bore acts to compress the gas as it travels towards the outlet. Alternatively the liquid openings may themselves have a helical form as in FIG. 5B forming helical blades. In this case the helical form of the thread and blades progress in opposite directions, such that if the helical thread descends in a clockwise direction, the helical blades descend in an anti-clockwise direction. This is shown in more detail for a non-tapered bore embodiment in FIG. 5F.

Owing to the tapered bore the liquid blade towards the gas outlet is smaller than it is towards the inlet and is therefore able to support an increased differential pressure. The power required to drive the rotor to pump the fluid in such an arrangement is also significantly reduced.

Figure 5E:
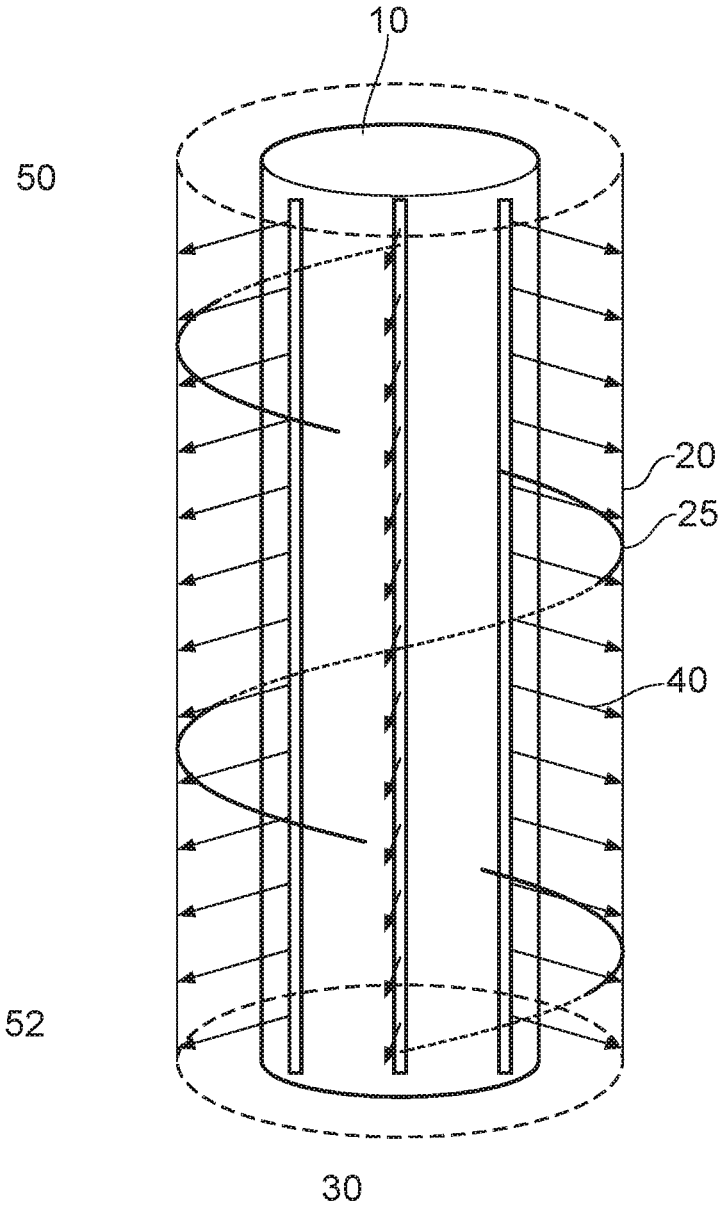

A concentric arrangement with a non-tapered stator and a helical thread 25 on the stator 20 is shown in FIG. 5E. The rotor 10 is again immersed at one end in a liquid reservoir 30 and liquid rising up the hollow shaft is output through longitudinal slots to form longitudinal liquid blades 40 which sweep gas along a helical path defined by thread 25, stator bore 20 and rotor 10 from a gas inlet 50 to a gas outlet 52.

Figure 5F:
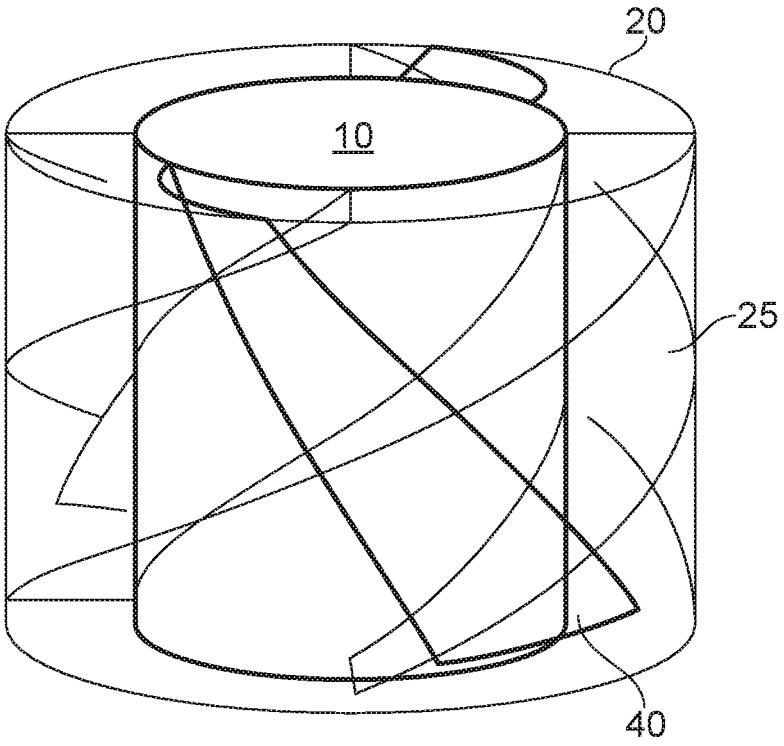

FIG. 5F shows an alternative concentric arrangement also comprising an internal helical thread 25 on the stator bore 20 but where the liquid blades 40 are helical blades rather than longitudinal blades.

For several of these liquid blade arrangements, the number of pump stages can be increased to increase capacity as is known in the art of the conventional mechanical pumps.

Figure 6:
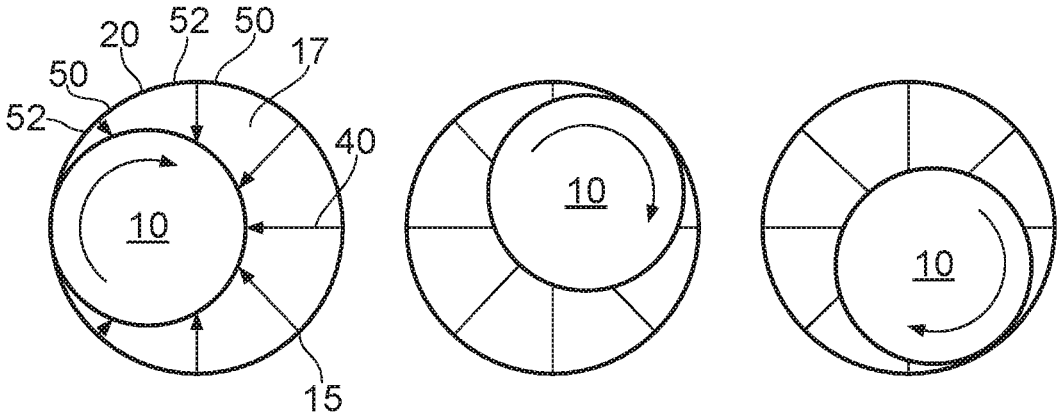
FIG. 6 shows a multistage piston type pump according to an embodiment.

FIG. 6 shows a cam shaft of rotor 10 and non-rotational liquid blades 40 extending from the stator 20 towards the cam shaft of rotor 10 providing a multistage displacement pump analogous to a multistage piston pump. The embodiment allows different numbers of pumping stages depending upon how many liquid blades 40 are used. The liquid openings 15 for providing the liquid blades can be positions on the stator bore 20 and pumping chambers denoted as 17 are provided by these surfaces and the surfaces of the stator bore 20 and cam shaft of rotor 10. Rotation of the cam shaft of rotor 10 in the bore causes these pumping chambers 17 to change in volume as can be seen from the figures where the progression of the cam shaft and corresponding change in volume of the pumping chambers 17 is shown. A plurality of pairs of gas inlet 50 and outlets 52 are arranged between each liquid blade 40 and each comprises a valve. As the cam shaft rotates, a pumping chamber will expand and gas will be drawn in through a gas inlet 50. On further rotation the pumping chamber 17 will contract and the gas will be expelled through a gas outlet 52. The rotor 10 will then cause the subsequent pumping chamber to change in volume. In this way the pairs of ports 50, 52 form stages in the pumping process and may be connected in series for higher pressure differences or in parallel for greater capacity. The blades 40 are fixed in position being formed from openings 15 on the stator allowing the valves also to be in a fixed position.

Although in many of the embodiments described above the liquid circulation providing the liquid surface is generated by a rotating rotor providing a centrifugal force on the liquid, in some embodiments an alternative way of generating the liquid circulation is used, namely that of a high pressure liquid source.

Such a high pressure liquid supply or pump could be used separately or in conjunction with regulated shaft rotation—enabling independent variability of both fluid velocity and shaft frequency according to pumping performance requirements allowing controllable efficiency and pump tuning.

Figure 7:
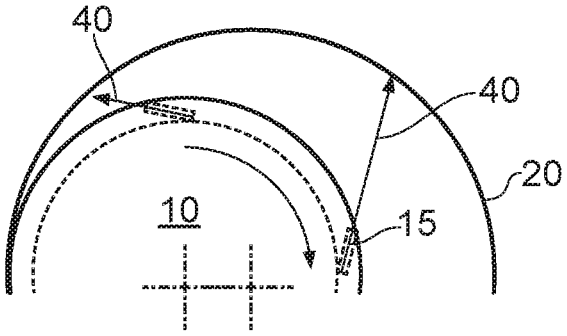
FIG. 7 shows a self driven rotor driven by liquid flow from slots which are non perpendicular to the surface of the rotor.

FIG. 7 shows a shaft with nominally tangential holes/slots 15. This embodiment uses an external source to provide the high pressure liquid to the shaft. In this embodiment not only does the high pressure liquid supply provide the liquid flow for the deformable liquid surface 40 it also provides the force to drive rotation of the shaft of rotor 10 from the water pressure.

In some embodiments, the pump may be used in a wet scrubbing environment so that the pumping function may be integrated into the wet scrubbing, the liquid blades being an advantage in such an embodiment. In this regard, by placing one of the liquid blade pumps in line with process gas flow the pump may be used for wet scrubbing in addition to vacuum generation—for example on the outlet (or inlet) of an abatement system.

In some embodiments, hydrodynamic bearings (reference numeral 16 as shown in FIG. 1) from the same high pressure liquid source as the liquid blades are used to support the rotary motion of the shaft—thus further simplifying and reducing the cost of the pump.

Where a means to drive the shaft is required such as a motor and frequency inverter or belt drive, such a drive system may preferentially be positioned at the top of the shaft to reduce risk of liquid leaking into the drive means.

In summary, embodiments function effectively where a circulation of liquid that meets or exceeds the emission from the liquid openings can be achieved. This helps sustain the blades as a continuous surface and prevents leaks between pumping chambers. It should be noted that many parameters such as the size of the liquid openings, the type of liquid used, the liquid velocity, the distance between rotor and stator and the length of rotor and its speed of rotation all affect the formation and maintenance of the liquid surfaces. Thus, these features should be selected depending on the properties required of a particular pump, such as power consumption, pumping capacity and compression.

Although illustrative embodiments of the disclosure have been disclosed in detail herein, with reference to the accompanying drawings, it is understood that the disclosure is not limited to the precise embodiment and that various changes and modifications can be effected therein by one skilled in the art without departing from the scope of the disclosure as defined by the appended claims and their equivalents.

The invention claimed is:

1. A positive displacement vacuum pump for pumping a gas, the positive displacement vacuum pump comprising:

a gas inlet and a gas outlet;

a rotor and a stator, the stator defining a stator bore, wherein the rotor is located within the stator bore;

a shaft connected with the rotor and configured to rotate the rotor within the stator bore, wherein the stator bore surrounds the rotor and the shaft;

at least the rotor comprising at least one liquid opening configured for fluid communication with a liquid source a bottom portion of the rotor and the shaft each being at least partially immersed in the liquid source located in a liquid reservoir at the bottom of the stator bore; and the at least one liquid opening being configured such that, in response to a driving force exerted on liquid from the liquid source, a stream of liquid is output from the at least one liquid opening, the stream of liquid forming a liquid blade between the rotor and the stator, within the stator bore, wherein the gas is confined by the stator, the rotor, and the liquid blade and the liquid blade drives the gas through the positive displacement vacuum pump from the gas inlet towards the gas outlet, wherein the shaft extends away from and above the liquid reservoir within the stator bore in a vertical direction, and wherein a longitudinal axis of the shaft of the rotor and a longitudinal axis of the stator are orientated in the vertical direction.

2. The positive displacement vacuum pump according to claim 1, wherein the stream of liquid forming the liquid blade between the rotor and the stator is operable to drive the gas through the positive displacement vacuum pump on rotation of the rotor.

3. The positive displacement vacuum pump according to claim 2, further comprising at least one hydrodynamic bearing using a liquid film with liquid from the liquid source to support at least one end of the rotor.

4. The positive displacement vacuum pump according to claim 1, further comprising a driving mechanism for exerting the driving force on the liquid to drive the liquid from the liquid source through the at least one liquid opening.

5. The positive displacement vacuum pump according to claim 4, wherein the rotor is a hollow body and the driving mechanism comprises a motor for rotating the rotor and the shaft.

6. The positive displacement vacuum pump according to claim 5, wherein the liquid source comprises water.

7. The positive displacement vacuum pump according to claim 5, wherein the rotor has an intake opening at a lower end extending into the liquid reservoir, wherein an internal diameter of said hollow body is greater than an internal diameter of the intake opening.

8. The positive displacement vacuum pump according to claim 1, wherein the at least one liquid opening is formed on a surface of the rotor.

9. The positive displacement vacuum pump according to claim 1, wherein the rotor and the stator are mounted, such that the rotor comprises an inner component and the stator comprises an outer component, wherein the inner component is concentrically mounted within a bore of the outer component.

10. The positive displacement vacuum pump according to claim 1, wherein the rotor is eccentrically mounted within the bore of the stator.

11. The positive displacement vacuum pump according to claim 1, wherein the at least one liquid opening extends along at least a portion of a length of the rotor, the at least one liquid opening being configured to provide the liquid blade as a surface extending at least partially in an axial direction between the stator and the rotor.

12. The positive displacement vacuum pump according to claim 1, wherein the at least one liquid opening is arranged in the form of a helix extending around a surface of the rotor, the at least one liquid opening being configured to provide the liquid blade as a helical surface between the stator and the rotor.

13. The positive displacement vacuum pump according to claim 12, wherein an angle of the helix changes from the gas inlet towards the gas outlet such that a pitch of the helix reduces towards the gas outlet.

14. The positive displacement vacuum pump according to claim 1, wherein the stator is tapered such that a distance between the stator and the rotor reduces from the gas inlet towards the gas outlet.

15. The positive displacement vacuum pump according to claim 1, wherein the at least one liquid opening comprises a plurality of liquid openings.

16. The positive displacement vacuum pump according to claim 15, wherein the plurality of liquid openings provide a plurality of streams of liquid which form a plurality of liquid blades between the rotor and the stator.

17. The positive displacement vacuum pump according to claim 16, wherein the qas inlet and the qas outlet comprise a plurality of pairs of gas inlets and gas outlets, each pair of gas inlets and gas outlets of the plurality of pairs of qas inlets and qas outlets being separated by a corresponding liquid opening providing the liquid blade between each pair of gas inlets and gas outlets.

18. The positive displacement vacuum pump according to claim 1, wherein, during operation of the positive displacement vacuum pump, the pump is configured so that the liquid blade, an external surface of the rotor, and an internal surface of the stator that defines the stator bore form surfaces of at least one pumping chamber for moving the gas from the gas inlet towards the gas outlet.

19. A wet scrubber for reducing pollutants pumped from an abatement system, the wet scrubber comprising the positive displacement vacuum pump according to claim 1.

20. The positive displacement vacuum pump of claim 1, wherein during operation of the pump a gas pocket is defined by the stator, the rotor, and the liquid blade and the rotation of the rotor causes a change in volume of the gas pocket.

21. A method of positive displacement pumping of a gas comprising:

outputting liquid from at least one liquid opening on a rotor to form a liquid blade between an external surface of the rotor and an internal surface of a stator, wherein a shaft is connected to the rotor and configured to rotate the rotor within a bore of the stator, wherein remaining liquid from the liquid blade flows back down the surface of the stator in a vertical direction into a liquid reservoir;

wherein the rotor extends away from and above the liquid reservoir within the stator bore in the vertical direction; and wherein a longitudinal axis of the shaft of the rotor and a longitudinal axis of the stator are orientated in the same vertical direction; and rotating the rotor and thereby causing gas confined by the stator, the rotor, and the liquid blade to travel along a pumping path from a gas inlet to a gas outlet.

22. The method according to claim 21, wherein rotating the rotor further includes rotating the rotor within the stator bore to cause the liquid blade to drive the gas along the pumping path.

23. A positive displacement vacuum pump for pumping a gas, said pump comprising:

a rotor and a stator defining a stator bore, the rotor received within the stator bore; and a shaft connected to the rotor and configured to eccentrically rotate the rotor within the stator bore, the rotor comprising at least one liquid opening configured for fluid communication with a liquid source;

wherein the at least one liquid opening, in response to a driving force exerted on the liquid from the liquid source, outputs a stream of liquid from the at least one liquid opening, the stream of liquid forming a liquid blade between the rotor and the stator, wherein the gas confined by the stator, the rotor, and the liquid blade within the stator bore is driven through the pump from a gas inlet towards a gas outlet via the eccentric rotation of the rotor, and wherein during operation of the pump a gas pocket is defined by the stator, the rotor, and the liquid blade and the rotation of the rotor causes a change in volume of the gas pocket.

* * * * *